United States Patent [19]

Duhon

[11] Patent Number: 4,987,277

[45] Date of Patent: Jan. 22, 1991

[54] NORMALLY CLOSED PRESSURE-ACTUATED SWITCH

[75] Inventor: Edward W. Duhon, Setauket, N.Y.

[73] Assignee: Tapeswitch Corporation of America, Farmingdale, N.Y.

[21] Appl. No.: 472,710

[22] Filed: Jan. 31, 1990

[51] Int. Cl.[5] ..... H01H 3/02

[52] U.S. Cl. ..... 200/86 R; 200/85 R

[58] Field of Search ..... 200/86 R, 85 R

[56] References Cited

U.S. PATENT DOCUMENTS 2,770,696 11/1956 Koenig ..... 200/86
3,553,404 1/1971 Koenig ..... 200/86
3,717,735 2/1973 Koenig ..... 200/86
4,296,283 10/1981 Koenig et al. ..... 200/86

*Primary Examiner*—Robert S. Macon
*Attorney, Agent, or Firm*—Hoffmann & Baron

[57] ABSTRACT

A normally-closed electrical switch having a plurality of electrically conductive contacts normally arranged in overlapping electrical communication. A preferred embodiment of the present invention also comprises a pressure directing mechanism for directing and actuating pressure to specific portions of the electrically conductive elements. The normally-closed electrical switch of the present invention interrupts an electrical circuit in response to an applied pressure.

23 Claims, 2 Drawing Sheets

Fig. 1
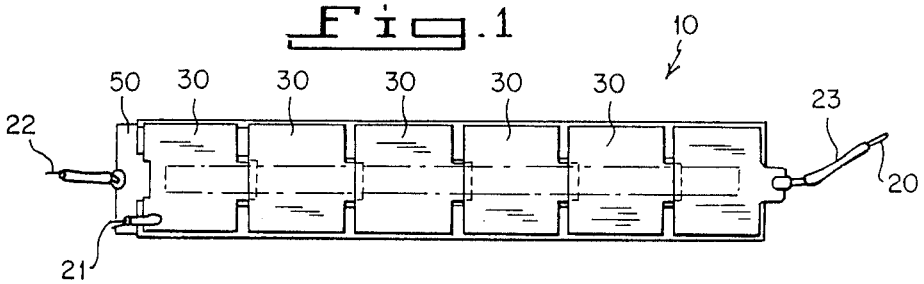
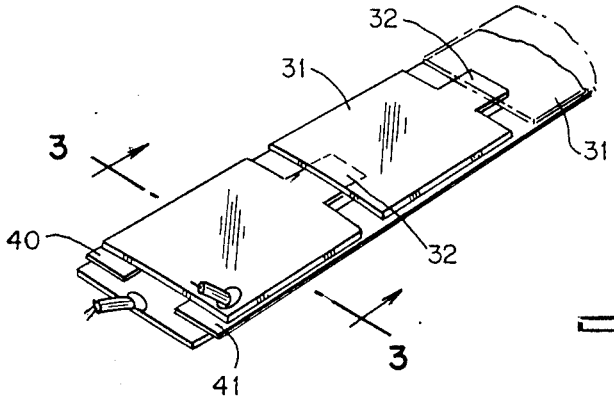
Fig. 2
Fig. 3
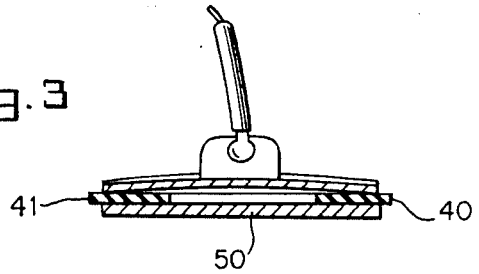
Fig. 4
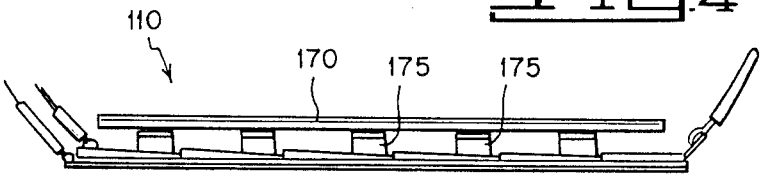
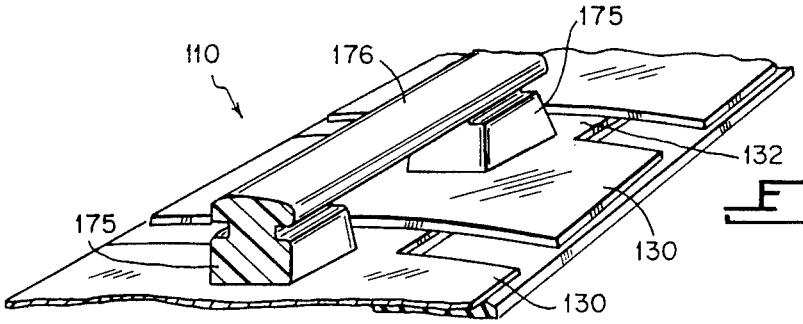
Fig. 5

Fig. 9
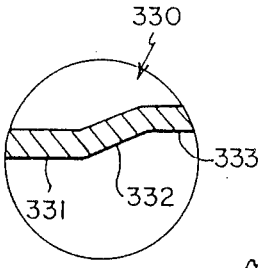
Fig. 6
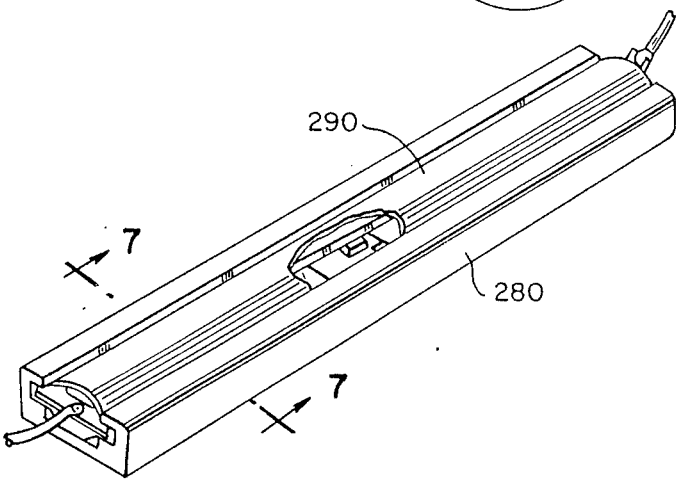
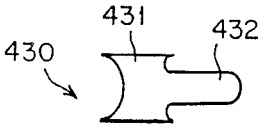
Fig. 10
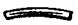
Fig. 11
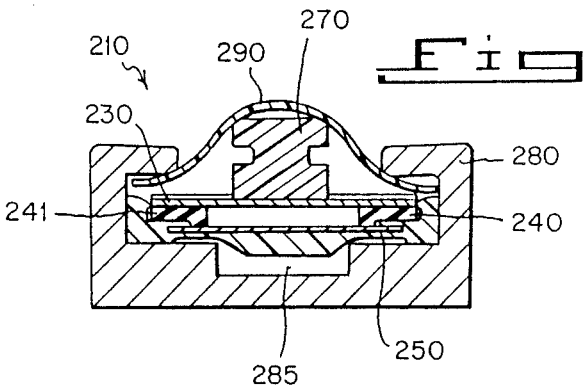
Fig. 7
Fig. 8
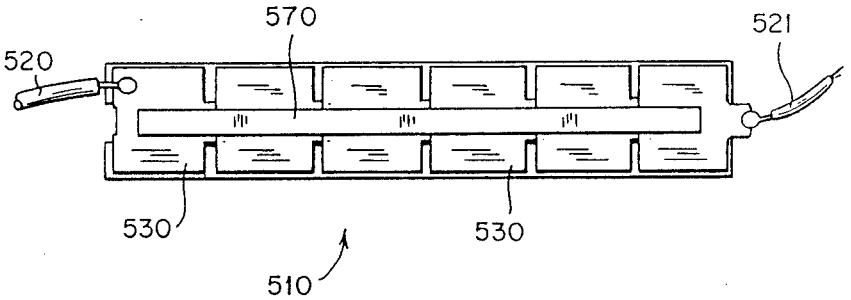

NORMALLY CLOSED PRESSURE-ACTUATED SWITCH

The present invention is directed to an electrical pressure-actuated switch and, more particularly, to a electrical pressure-sensitive switch which is normally in a closed position.

BACKGROUND OF THE INVENTION

A normally-closed switch is a switch designed to permit the flow of electricity through the switch when that switch is in a "normal" or non-distorted configuration. Such switches are useful in a wide variety of safety and security applications, for example, for detecting the movement of large pieces of furniture or valuables. For example, a safe may be placed on a pressure actuated normally-closed electrical switch thereby interrupting the electrical circuit which could typically be connected to an alarm system. If the safe was removed from that location, the switch would return to its "normally" closed position, thereby completing the electrical circuit and activating the alarm. Other applications include the placement of normally-closed switches in industrial work areas where the switches are used to detect the presence of personnel in close proximity to dangerous machinery. In these applications, the switches can be utilized to disrupt the electrical circuitry which powers the dangerous equipment thereby deactivating the equipment when a person moves dangerously close to that equipment. Other applications have and will be appreciated by those skilled in the art for pressure-sensitive normally-closed electrical switches.

Included among the normally-closed electrical switches known in the art are those disclosed in U.S. Pat. No. 3,553,404 to Koenig, 3,717,735 to Koenig, and 4,296,283 to Koenig et al.

U.S. Pat. No. 3,553,404 discloses a normally-closed pressure switch having a pair of curved contact members disposed between parallel stiffener plates and separated at the edges by insulators. When a force is applied to the stiffener plates, the stiffener plates cause the curved contacts to straighten thereby breaking the electrical contact between the curved contacts.

U.S. Pat. No. 3,717,735 discloses a normally closed switch having two conductor strips with transverse curvature. This normally-closed switch is "flex sensitive" such that when the switch is flexed, the strips lose their transverse curvature and the contact between the conductor strips is broken.

U.S. Pat. No. 4,296,283 similarly discloses a normally-closed "wafer" switch having outer stiff plates, inner contact plates having transverse curvatures wherein the contact plates are aligned so that their axes of curvatures are perpendicular, and an insulating plate disposed between the curvature plates.

In addition to the normally closed electrical switches discussed above, many types of normally-open pressure sensitive switches are known in the art. Included among such normally open switches is the tape switch disclosed in U.S. Pat. No. 2,770,696 to Koenig which is adapted to be actuated by the weight of a person or vehicle passing over it.

The above-described normally closed electrical switches are, for practical purposes, limited in size and design. Unlike the novel switch described herein, the typical normally-closed switches referenced above were designed to open upon the application of force to the entire length of the strip as opposed to pressing at any point.

SUMMARY OF THE INVENTION

The present invention is directed to a pressure-sensitive normally-closed electrical switch having a plurality of electrically conductive contacts normally arranged in overlapping electrical communication. A preferred embodiment of the present invention also comprises a pressure directing mechanism for directing and actuating pressure to specific portions of the electrically conductive elements. The normally-closed electrical switch of the present invention interrupts an electrical circuit in response to an applied pressure.

BRIEF DESCRIPTION OF THE DRAWINGS

FIG. 1 is a plan view of the conductive elements of a normally-closed switch of one embodiment of the present invention.

FIG. 2 is a perspective view of one end of the normally-closed switch illustrated in FIG. 1.

FIG. 3 is a cross sectional end view taken along Lines 3—3 of FIG. 2.

FIG. 4 is a side view of a second embodiment of the present invention illustrating the positioning of a pressure directing member.

FIG. 5 is a perspective view of a portion of the embodiment illustrated in FIG. 4.

FIG. 6 illustrates a third embodiment of the present invention.

FIG. 7 is a cross-sectional end view of the embodiment illustrated in FIG. 6 taken along lines 7—7.

FIG. 8 illustrates a fourth embodiment of the present invention.

FIG. 9 is a side view of a contact member utilized in an alternative embodiment of the present invention.

FIGS. 10 and 11 are plan and end views, respectively, of a contact element utilized in still another embodiment of the present invention.

DETAILED DESCRIPTION

The present invention is a normally-closed pressure sensitive electrical switch having a plurality of at least partially overlapping contact elements normally disposed in electrical communication. As used herein, the terms "normal" and "normally" refer to the configuration of a switch or element when that switch or element is not subject to an external force.

According to one embodiment of the present invention as illustrated in FIGS. 1–3, the normally-closed switch 10 comprises three electrical leads 20, 21, 22 for connecting the normally closed switch 10 to at least one electrical device or control (not illustrated). As illustrated in FIG. 1, it may be desirable to provide an insulating material 23 on the leads 20, 21, 22. Normally-closed switch 10 comprises a number of partially overlapping contact elements 30. While FIG. 1 illustrates an embodiment of the present invention having only six overlapping contact elements 30, the present invention can be practiced using fewer or a much greater number of overlapping contact elements to form a long normally-closed switch.

With reference to FIG. 2, each contact element 30 preferably comprises a body portion 31 and a tongue portion 32. When the contact members are formed in this manner, each contact element 30 can be arranged such that the tongue portion 32 is normally located in overlapping arrangement with the body portion 31 of the adjacent contact element 30. As illustrated in FIGS. 1 and 2, the tongue portion 32 is preferably disposed below the body portion 31 of the adjacent contact element 30. The contact elements 30 are preferably formed of a highly electrically conductive material which has enough resiliency to permit the contact element 30 to deform under pressure thereby moving the tongue portion 32 away from the body portion 31 of an adjacent contact element.

For example, the contact elements can be formed of any material known in the art which provides the desired degree of resiliency without breaking and has sufficient electrical conductivity. Examples of suitable materials include copper sheets having a thickness of about 0.005–0.125 inches, nickel sheets having a thickness of about 0.005–0.125 inches, or beryllium, copper, or alloys thereof. The overall size of each electrical contact can vary widely. Electrical contacts having a body portion with a length and width of about 0.125–4.50 inches and a tongue portion of about 0.125–2.75 inches are suitable.

The contact elements are arranged such that when a force is applied to a section of the normally-closed switch 10, at least one of the contact elements 30 will deform in a manner which causes the tongue portion 32 to move more than the corresponding body portion 31 of the adjacent electrical contact 30, In this manner the electrical communication between the adjacent contact elements 30 is broken and the switch is "opened". When the externally applied force is removed, the resilient contact element 30 returns to its relaxed position thereby restoring the electrical communication between the adjacent electrical contact elements and returning the switch 10 to its normally-closed position and closing the electrical circuit.

In the embodiments illustrated in FIGS. 1–5, the normally-closed switch 10 is provided with an additional electrically conductive strip 50 which is connected to an external control or device via electrical lead 22. The conductive strip 50 is disposed a predetermined distance from the contact elements 30 and is separated therefrom by insulating strips 40, 41. As illustrated in FIG. 3, insulating strips 40, 41 are disposed toward the external edges of normally-closed switch 10 in order to separate the contact elements 30 from the conductive strip 50. Conductive strip 50 is located in proximity to the contact elements 30 such that when a force of a predetermined magnitude is applied to a contact element 30 the tongue portion 32 of that contact element 30 is not only displaced away from the body portion 31 of the adjacent contact element 30 but is moved into electrical contact with the conductive strip 50. In this manner, while the electrical contact between leads 20 and 21 is broken, electrical communication is established between lead 21 and lead 22. Lead 22 may be connected to an alarm or any other desired circuit.

The conductive strip 50 is not necessary for the practice of the present invention and may be omitted. as shown in the embodiment of FIG. 8, a normally-closed switch 510 of the present invention has contact elements 530, which normally provide electrical communication to leads 520,521, and a pressure director 570.

With reference to FIGS. 4 and 5 which illustrate a second preferred embodiment of the present invention, the normally-closed switch 110 is provided with a pressure directing member 170. Pressure directing member 170 has a plurality of pressure directing elements 175 which are connected by a connecter bar 176. As illustrated in FIG. 5, the pressure directing elements 175 are preferably positioned on each contact element 130 near the tongue portion 32. Pressure directing element 170 advantageously directs a force applied to the normally-closed switch 110 only to that portion of each contact element 130 which will move away from the adjacent contact element 130. It will be appreciated by those skilled in the art that the connecter bar 176 is not necessary for the pressure directing elements to direct the externally applied force to the contact elements 130, however, connecter bar 176 prevents a localized force from contacting switch 110 at a location on the contact elements 130 less likely to cause tongue portions 132 to move away from the adjacent contact elements 130.

FIGS. 6 and 7 illustrate another preferred embodiment of the normally-closed pressure-sensitive switch of the present invention wherein a normally closed switch having a pressure directing member, and a conductive strip as described above are enclosed within a protective housing. With reference to the cross sectional view illustrated in FIG. 7, normally-closed switch 210 comprises a plurality of overlapping contact elements 230 separated from a conductive strip 250 by two insulative strips 240, 241 and a pressure directing member 270. In accordance with this embodiment of the present invention, the normally-closed switch comprises a support base 280 and a resilient cover 290. Support base 280 is preferably formed of a rigid material such as a metal or high impact polymer which will normally maintain the contact elements 230 in electrical communication. As illustrated in FIG. 7, base member 280 is provided with an upper longitudinal recess 285 which substantially protects at least three sides of the working elements of switch 210. In order to protect the electrically conductive elements of normally-closed switch 210 from dust and other potentially harmful particles, longitudinal recess 285 is advantageously covered with a resilient cover 290. Cover 290 is advantageously formed of a wear-resistent, resilient material such as PVC or Lexan TM, having a thickness of about 0.003–0.150 inches, however, it will be appreciated by those skilled in the art that other materials may be utilized.

The base member 280 and cover 290 of normally-closed switch 210 provide additional protection for switch 210 which is particularly adapted for used in industrial areas where switch 210 may be used on surfaces which are not substantially flat. By providing a longitudinal recess on only one side of base member 280, the operation of switch 210, i.e. the interruption of a normally-closed circuit, is limited to forces originating from that side of switch 210.

FIG. 9 illustrates an alternative embodiment of a contact element which may be utilized in accordance with the present invention. The contact element 330 acts as a living hinge to provide additional resiliency. Contact element 330 generally comprises three portions, lower back portion 331, an inclined mid-portion 332, and an upper contact portion 333. The inclined mid-portion 332, provides added resiliency to contact element 330 and thereby helps to maintain the upper contact portion 333 in contact with a lower back portion 331 of an adjacent contact element 330.

FIGS. 10 and 11 illustrate another contact element 430 having a gill configuration with a body portion 431 and a tongue portion 432. The body portion 431 has substantially straight sides and curved ends. Tongue portion 432 is designed for placement below the body portion 431 of an adjacent contact element. As illustrated in FIG. 11, contact element 430 has an arcuate cross section. This arcuate cross section provides additional strength to contact element 430 and helps to restore contact element 430 to its original configuration after the removal of an externally applied force.

From the description above, it will be appreciated by those skilled in the art that the contact elements used in accordance with the present invention, may take many configurations including generally rectangular, oval, circular as well as many irregular shapes. The main requirement of the contact elements of the present invention is that the contact elements are normally in contact and can be moved or distorted to break that contact thereby interrupting the electrical circuit and opening the normally closed switch.

I claim:

1. A normally-closed electrical switch comprising:

a plurality of electrically conductive contacts normally arranged in overlapping electrical communication, wherein said contacts are separable in response to an applied pressure which thereby interrupts said electrical communication.

2. A normally-closed switch according to claim 1 wherein said switch comprises at least three of said electrically conductive contacts.

3. A normally-closed switch according to claim 1 wherein said contacts are formed of a resilient material.

4. A normally-closed switch according to claim 1 wherein said switch further comprises at least one pressure directing element for focusing an applied pressure on at least one of said contacts.

5. A normally closed switch according to claim 3 comprising a plurality of pressure directing elements and wherein one pressure directing member is aligned for contact with each of said contact.

6. A normally closed switch according to claim 5 further comprising a connector attached to each of said pressure directing elements.

7. A normally-closed switch according to claim 1 wherein said switch comprises at least three of said electrically conductive contacts, wherein at least one of said contacts has a body portion and a flexible tongue portion, and wherein said switch further comprises means for rigidly supporting said body portion of said contact such that said flexible portion of said contacts are normally arranged in overlapping electrical communication with said body portion of an adjacent contact.

8. A normally-closed switch according to claim 1 wherein said contacts are resilient.

9. A normally-closed switch according to claim 1 further comprising a conductive strip disposed in close proximity to said contacts.

10. A normally-closed switch according to claim 9 wherein said conductive strip is disposed such that at least one of said contacts touches said conducting strip in response to an applied pressure.

11. A normally-closed pressure-sensitive electrical switch comprising:

a plurality of electrically conductive contacts arranged in overlapping electrical communication, and at least one pressure directing member disposed above a contact for directing an applied pressure to said contact thereby interrupting said electrical communication.

12. A normally-closed pressure-sensitive electrical switch according to claim 11 further comprising a conductive strip disposed below said contacts and separated from said contacts by at least one insulating strip.

13. A normally-closed pressure-sensitive electrical switch according to claim 12 wherein said conductive strip is separated from said contacts by two insulating strips.

14. A normally-closed pressure-sensitive electrical switch according to claim 11 wherein said contacts, said pressure directing member, and said conductive strip are at least partially disposed within a housing.

15. A normally-closed pressure-sensitive electrical switch according to claim 14 wherein said housing comprises a slot and wherein said pressure directing member extends at least partially through said slot.

16. A normally-closed pressure-sensitive electrical switch according to claim 15 wherein said slot is covered with a resilient cover.

17. A normally-closed pressure-sensitive electrical switch according to claim 16 wherein said cover is water-proof.

18. A normally-closed pressure-sensitive electrical switch according to claim 11 wherein said contacts are resilient.

19. A normally-closed pressure-sensitive electrical switch according to claim 11 wherein at least one of said contacts comprises a body portion and a tongue portion and wherein said tongue portion extends at least partially under an adjacent contact.

20. A normally-closed pressure-sensitive electrical switch according to claim 19 wherein said body portion is substantially rectangular.

21. A normally-closed pressure-sensitive electrical switch according to claim 19 wherein said body portion is substantially oval.

22. A normally-closed pressure-sensitive electrical switch according to claim 11 wherein at least one of said contacts has an arcuate cross-section.

23. A normally-closed pressure-sensitive electrical switch according to claim 11 wherein at least one of said contacts has a gill shape.

* * * * *